US010047415B2

(12) United States Patent
Sakairi et al.

(10) Patent No.: US 10,047,415 B2
(45) Date of Patent: Aug. 14, 2018

(54) METALLIC WIRE ROD COMPRISING IRIDIUM-CONTAINING ALLOY

(75) Inventors: Koichi Sakairi, Kanagawa (JP); Kunihiro Tanaka, Kanagawa (JP); Muneki Nakamura, Kanagawa (JP); Fumie Seki, Tokyo (JP)

(73) Assignee: Tanaka Kikinzoku Kogyo K.K., Tokyo (JP)

( * ) Notice: Subject to any disclaimer, the term of this patent is extended or adjusted under 35 U.S.C. 154(b) by 608 days.

(21) Appl. No.: 13/882,572

(22) PCT Filed: Dec. 15, 2011

(86) PCT No.: PCT/JP2011/079033
§ 371 (c)(1),
(2), (4) Date: Apr. 30, 2013

(87) PCT Pub. No.: WO2012/090714
PCT Pub. Date: Jul. 5, 2012

(65) Prior Publication Data

US 2013/0213107 A1 Aug. 22, 2013

(30) Foreign Application Priority Data

Dec. 27, 2010 (JP) ..... 2010-289557

(51) Int. Cl.

| | |
|---|---|
| ***C22C 28/00*** | (2006.01) |
| ***C22C 5/04*** | (2006.01) |
| ***C22F 1/14*** | (2006.01) |
| ***B21C 1/16*** | (2006.01) |
| ***B21C 1/00*** | (2006.01) |
| *H01T 13/39* | (2006.01) |

(52) U.S. Cl.
CPC ..... *C22C 28/00* (2013.01); *B21C 1/003* (2013.01); *B21C 1/16* (2013.01); *C22C 5/04* (2013.01); *C22F 1/14* (2013.01); *H01T 13/39* (2013.01)

(58) Field of Classification Search
CPC ..... C22C 1/0466; C22C 5/04; C22F 1/14
See application file for complete search history.

(56) References Cited

U.S. PATENT DOCUMENTS

| | | | | |
|---|---|---|---|---|
| 2004/0025986 | A1* | 2/2004 | Perry | C22C 5/04 148/577 |
| 2010/0239453 | A1 | 9/2010 | Obata | 420/461 |

FOREIGN PATENT DOCUMENTS

| | | |
|---|---|---|
| JP | 07-268574 | 10/1995 |
| JP | 2000-331770 | 11/2000 |
| JP | 2002-359052 | 12/2002 |
| JP | 2010-218778 | 9/2010 |
| WO | WO 2009/107289 | 9/2009 |

OTHER PUBLICATIONS

Hecker, S. S., D. L. Rohr, and D. F. Stein. "Brittle fracture in iridium." Metallurgical Transactions A 9.4 (1978): 481-488.*
Supplementary European Search Report, EP 11853343.9, dated Aug. 8, 2016.
Adamesku, R., et al : "On Mechanical Twinning in Iridium Under Compression At Room Temperature", Journal of Materials Science Letters, Chapman and Hall Ltd., London, GB, vol. 13, Jan. 1, 1994, pp. 865-867.
E.B. Tadmore, et al: "The Twinnability of FCC Metals: A Detailed Analysis", Technical report ETR-2004-03, Technion, Israel Institute of Technology, Faculty of Mechanical Engineering, May 2004, pp. 1-20.
Panfilov et al: "Crystallographic Structure and Mechanical Behaviour of Single Crystals of Ir—Sn Compound", Journal of Materials Science Letters, Chapman and Hall Ltd., London, GB, vol. 18, Jan. 1, 1999, pp. 1649-1652.
Panfilov et al: "The Plastic Flow of Iridium", Platinum Materials Rev. Jan. 1991, 35(4), pp. 196-200.

* cited by examiner

*Primary Examiner* — Keith Walker
*Assistant Examiner* — Jophy S. Koshy
(74) *Attorney, Agent, or Firm* — Roberts & Roberts, LLP

(57) ABSTRACT

The present invention is a metallic wire rod comprising iridium or an iridium-containing alloy and, the wire rod has in the cross section thereof biaxial crystal orientation of 50% or more of abundance proportion of textures in which crystallographic orientation has preferred orientation to <100> direction. In the present invention, crystal orientation in the outer periphery from semicircle of the cross section which is the periphery of the wire rod is important, and in this zone, abundance proportion of textures in which crystallographic orientation has preferred orientation to <100> direction is preferably not less than 50%.

9 Claims, 6 Drawing Sheets

AFTER HOT FORGING

AFTER HOT GROOVE ROLLING

AFTER HOT WIRE-DRAWING

WIRE ROD PRODUCT

AFTER HOT FORGING

AFTER HOT GROOVE ROLLING

METALLIC WIRE ROD COMPRISING IRIDIUM-CONTAINING ALLOY

FIELD OF THE INVENTION

The present invention relates to a metallic wire rod comprising an iridium-containing alloy used in applications such as spark plug electrodes and various sensor electrodes and used in a high-temperature oxidative atmosphere.

BACKGROUND OF THE INVENTION

Iridium wire rods are known as metallic wire rods used in such as electrodes for spark plugs (central electrodes and earth electrodes) and electrodes for various sensors. Electrodes for spark plugs are exposed to a high-temperature oxidation environment within combustion chamber, and thus, subjected to concerns about wear by high-temperature oxidation. Iridium belongs to precious metals and has high melting point and good oxidation resistance, and thus, can be used for a long term in high temperatures.

On the other hand, one that has better resistance to high-temperature oxidation is needed. As a method of improving the high-temperature oxidation resistance of an iridium wire rod, it is typical to appropriately alloy addition elements, such as rhodium, platinum, and nickel, for compositional improvement of constituent materials. Moreover, an example using a clad wire rod from combined two materials is also known recently (for example, Patent Literature 1). All of precious metals such as Pt and Ir are materials with high melting points; however, with strictly comparing, their spark wear resistances and oxidation resistances are different, and the respective advantages can be exploited using these clad materials.

Patent Literature 1

Japanese Patent Application Laid-Open No. 2002-359052

However, there is a limit in improvements based on compositional adjustments by alloying, and improvements in high-temperature oxidation resistance cannot be expected by thoughtlessly increasing the amounts of addition elements. Also, regarding to clad wire rods, however advanced processing techniques have been, there is a hindrance from a viewpoint of productivity to manufacture such a composite material as a homogeneous wire rod.

SUMMARY OF THE INVENTION

Problems to be Solved by the Invention

Therefore, it is an object of the present invention to provide iridium or a metallic wire rod containing iridium or iridium aiming for improvements in oxidation wear resistance from a non-conventional viewpoint and to provide a method of manufacturing the metallic wire rod.

Means for Solving the Problems

The present inventors have focused on, as an approach to solution of the above problems, the crystal orientation of metallic crystals constituting a wire rod. According to the present inventors, in iridium or an alloy containing iridium, wear due to its high-temperature oxidation originates from crystal grain boundaries, and has a tendency to develop therefrom. Furthermore, this tendency can be more seen in the state in which difference in crystallographic orientation between adjacent crystals is large (high angle grain boundary).

Now, with reference to crystal orientation of crystals in an iridium wire rod, a conventional wire rod is also not an aggregate of crystals having completely random crystallographic orientations, and has some degree of crystal orientation. This is because, in a polycrystal metal, preferred orientation easily developing by processing exists depending on its crystal structure, and because, in face-centered cubic metals such as iridium, <100> direction is preferred orientation, after processing into a wire rod, crystals having a fiber texture oriented to <100> direction exist more than crystals oriented to other orientation. However, in a processing step for typical wire rod, metallic crystal cannot be biaxially oriented to <100> direction (it will be detailed below). Furthermore, with the prior art, oxidation wear resistance of the entire wire rod will not be high, due in part to adjacently existing crystals that form high angle grain boundaries to <100> direction such as, for example, <111> orientation.

Therefore, based on the above viewpoint, the present inventors have conceived the present invention as a manufacturing step to increase abundance proportion of crystals oriented to preferable <100> direction and as a method of improving the oxidation wear resistance of iridium wire rod.

Namely, the present invention is a metallic wire rod comprising iridium or an iridium containing alloy and having biaxial crystal orientation in which abundance proportion of crystals in which crystallographic orientation is oriented to <100> direction in its cross section is not less than 50%.

A metallic wire rod according to the present invention is constituted in the basis of crystals in which crystallographic orientation is biaxially oriented to <100> direction (hereinafter, referred to as biaxially oriented crystal). More particularly, in the metallic wire rod, crystals in which crystals whose preferred orientation is <100> extends side by side to the vertical direction against the wire-drawing axis direction (longitudinal direction) and axial direction are constituted and, in its cross section, abundance proportion of crystals with <100> orientation is high. Abundance proportion of these biaxially oriented crystals is set to be not less than 50% because, if falling below this proportion, enhancement of high-temperature oxidation resistance due to decrease in high angle grain boundaries cannot be expected. Also, it goes without saying that the maximum of abundance rate of biaxially oriented crystals is desirably 100%; however, target maximum is preferably 80% with a long material shape of wire rod taken into consideration.

Furthermore, it is particularly preferable to ensure biaxial crystal orientation of this crystal in side portions of the wire rod. Erosion in oxidative atmosphere occurs from top layer of a side surface in electrodes of a plug, and thus, it is required to preclude erosion factors in the side of the wire rod. Specifically, in the outer periphery from semicircle of the cross section, abundance proportion of crystals in which crystals are biaxially oriented to <100> direction is preferably not less than 50%.

An iridium-containing alloy constituting the present invention includes an alloy containing rhodium, platinum, and nickel. Specifically, mention is made to an iridium alloy containing rhodium, platinum, and nickel in not more than 5% by weight with the remainder consisting of iridium. Moreover, it is contingent to contain iridium, and primary component may be other than iridium. Furthermore, with taking the condition to be excellent in high-temperature oxidation properties into consideration, iridium-containing alloy having platinum as primary component (iridium of 30% by weight or less) is also preferable.

Next, a method of manufacturing a wire rod according to the present invention is described. As described above, also in conventional iridium wire rod, crystals with <100> orientation which is preferred orientation by processing relatively abundantly exist. Here, as a manufacturing step of a typical wire rod, ingot is manufactured and this is made into a thin rod-shape article by hot processing such as forging (first step), and the article is processed into a wire rod with target wire diameter by line drawing (second step). Moreover, in the middle of processing into the rod-shape article from the ingot, the processing are conducted with performing an intermediate heat treatment, in order to mitigate material hardening due to processing distortion introduced by the processing. In this processing step, crystal with <100> orientation is likely to occur during forging and rolling (including groove rolling) on processing into the rod-shape article from the ingot, and crystals with <111> orientation are likely to occur during a subsequent line drawing. Particularly, in the periphery of the wire rod, crystal with <111> orientation is likely to occur due to friction between a tool and a work piece.

Manufacturing step of a wire rod according to the present invention is basically similar to the conventional processing step of a wire rod; however, as mentioned above, with considering variation of crystallographic orientation in line drawing, a material in which abundance rate of crystal with <100> orientation is equal to or higher than that in conventional one is intended to be obtained at the stage before line drawing.

As its specific approach, as a processing method in the first step to process the ingot into rod-shape article, processing by biaxial pressurization is conducted, wherein a material is simultaneously or alternatively compressed by pressures from vertically intersecting two directions. Crystals in a work piece are aligned by repeating the biaxial processing, allowing control of crystallographic orientation. This biaxial processing includes hot forging, hot rolling, hot processing by grooved roll and the like.

Furthermore, a method of increasing abundance proportion of biaxially oriented crystals in first step is to conduct temperature control of intermediate heat treatment without remaining excessive processing distortion in work piece. In the first step, multiple times of processing are conducted with performing intermediate heat treatment to reduce processing distortion, in order to maintain processability of the work piece; however, when intermediate heat treatment is conducted in the state with excessive processing distortion introduced, crystal orientation due to occurrence of new recrystallized grains occurs, resulting in impairment in biaxial crystal orientation due to processing in the middle of controlling. In the present invention, the maximum of processing distortion and the temperature range of intermediate heat treatment are restricted to maintain and grow crystal structure with crystal orientation.

Specifically, in the present invention, hardness of the work piece in the first step is maintained not more than 550 Hv, and temperatures of the intermediate heat treatment are controlled to not more than recrystallization temperature. The hardness of work piece is set to be not more than 550 Hv because, if the hardness is equal to or higher than it, excessive existence of processing distortion is indicated, appropriate intermediate heat treatment does not decrease the distortion sufficiently, and crack originating from high distortion area may occur in subsequent processing. The intermediate heat treatment is set to be not more than the recrystallization temperature because, with exceeding it, new recrystallized grains occur, leading to variation of preferred texture formed by the processing.

However, the recrystallization temperature here is a temperature in intermediate heat treatment depending on the processing degree. Namely, in the first step, hot groove rolling is conducted after performing hot forging, and in the hot forging in initial processing, the introduction of processing distortion is small, the processing degree is low and therefore, the recrystallization temperature is high (thus, hardness of the work piece is required to be not more than 550 Hv). On the other hand, hot groove rolling after hot forging is a processing step which the main part in the first step, wherein recrystallization temperature is reduced due to high processing degree. Therefore, temperature management of intermediate heat treatment in the first step is preferably relatively high temperatures (1400-1700° C.) in initial processing (hot forging) and 800° C. to not more than 1200° C. in subsequent processing (groove rolling). This is because decrease of processing distortion is insufficient at less than 800° C. and, recrystallized grain occurs at over 1200° C.

By limiting the processing direction in the first step described above and by controlling processing distortion (hardness) and the temperature of intermediate heat treatment, a rod-shape article having high abundance rate of crystals indicating <100> biaxial orientation can be obtained. Note that conventionally applied processing temperature (1000-1700° C.) can be applied to processing temperature of these processing (forging and groove rolling). Although this processing temperature is sometimes higher than the above intermediate heat treatment temperature, recrystallization cannot occur because the heating time is short. Note that reduction ratio in this first step is preferably set to be not less than 50%, and more preferably, set to be not less than 90%.

Furthermore, the rod-shape article manufactured by the first step is the one in which crystal structures preferentially oriented by repeatedly undergoing biaxial processing are produced. Then, by processing into a wire rod through second step by the wire drawing, the wire rod according to the present invention can be obtained. This wire drawing, to which processing conditions equivalent to that in conventional wire rod processing can be applied, preferably performed at stage in which the reduction ratio is not more than 50% in order to maintain <100> orientation, when intermediate heat treatment is conducted to reduce processing distortion.

Further, it is described in the above description that the formation of biaxially oriented structure can be made by repeating biaxial processing to the ingot, but the ingot is possibly said to preferably have crystal orientation at the stage of initial processing. Therefore, in a method of manufacturing a wire rod according to the present invention, it is particularly preferable to manufacture ingot of iridium or an iridium-containing alloy by rotation upward drawing process.

On manufacturing the ingot by rotation upward drawing, preferable upward drawing speed from molten alloy is 5-20 mm/min. In less than 5 mm/min, ingot diameter become too large, and casting defects may occur in the inside. Moreover, over 20 mm/min, ingot diameter become too thin and sufficient reduction ratio cannot be obtained, resulting in the difficulty to obtain homogeneous texture by the processing.

Advantageous Effects of Invention

The present invention is a wire rod in which crystals have crystal orientation, and this configuration allows for enhancing resistance to high-temperature oxidation.

DETAILED DESCRIPTION OF THE PREFERRED EMBODIMENTS

Hereinafter, preferred embodiments of the present invention are described. In the present embodiments, ingots of iridium and various iridium-containing alloys were manufactured by rotation upward drawing process, and these were processed into wire rods.

First Embodiment (Manufacturing of an Iridium Ingot)

Figure 1:
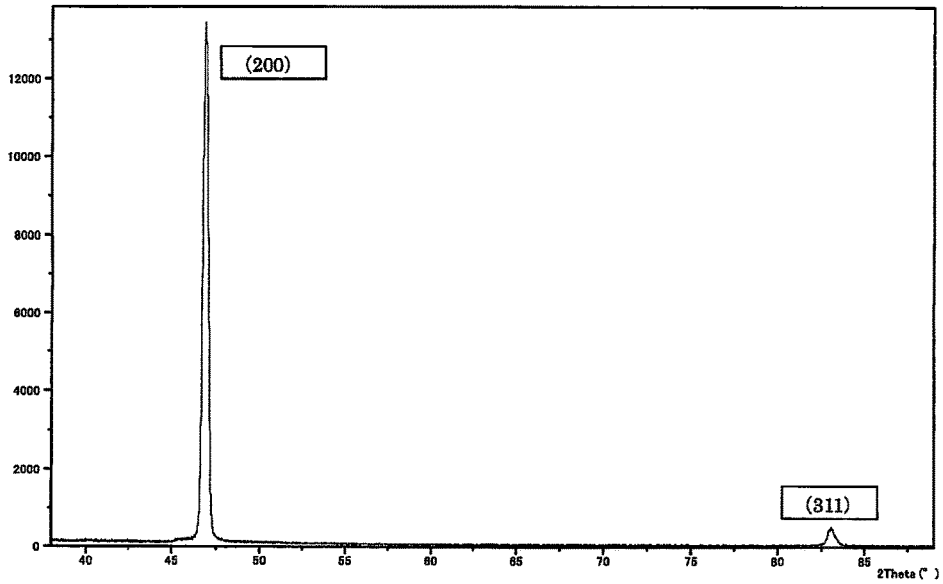
FIG. 1 is an X-ray diffraction result of iridium ingot manufactured by rotation upward drawing process in a first embodiment.

From molten alloy of iridium by high frequency melting using a water-cooled copper mold, iridium ingot with 12 mm diameter was manufactured by pulling-up method (pulling-up speed 10 mm/min). The iridium ingot manufactured in the present embodiment were subjected to X-ray diffraction for its midsection. The results are shown in FIG. 1, and the ingot manufactured by the rotation upward drawing process has the appearance of extremely high peak intensity of {100} plane and high crystal orientation.

(Wire Rod Processing)

Figure 2:
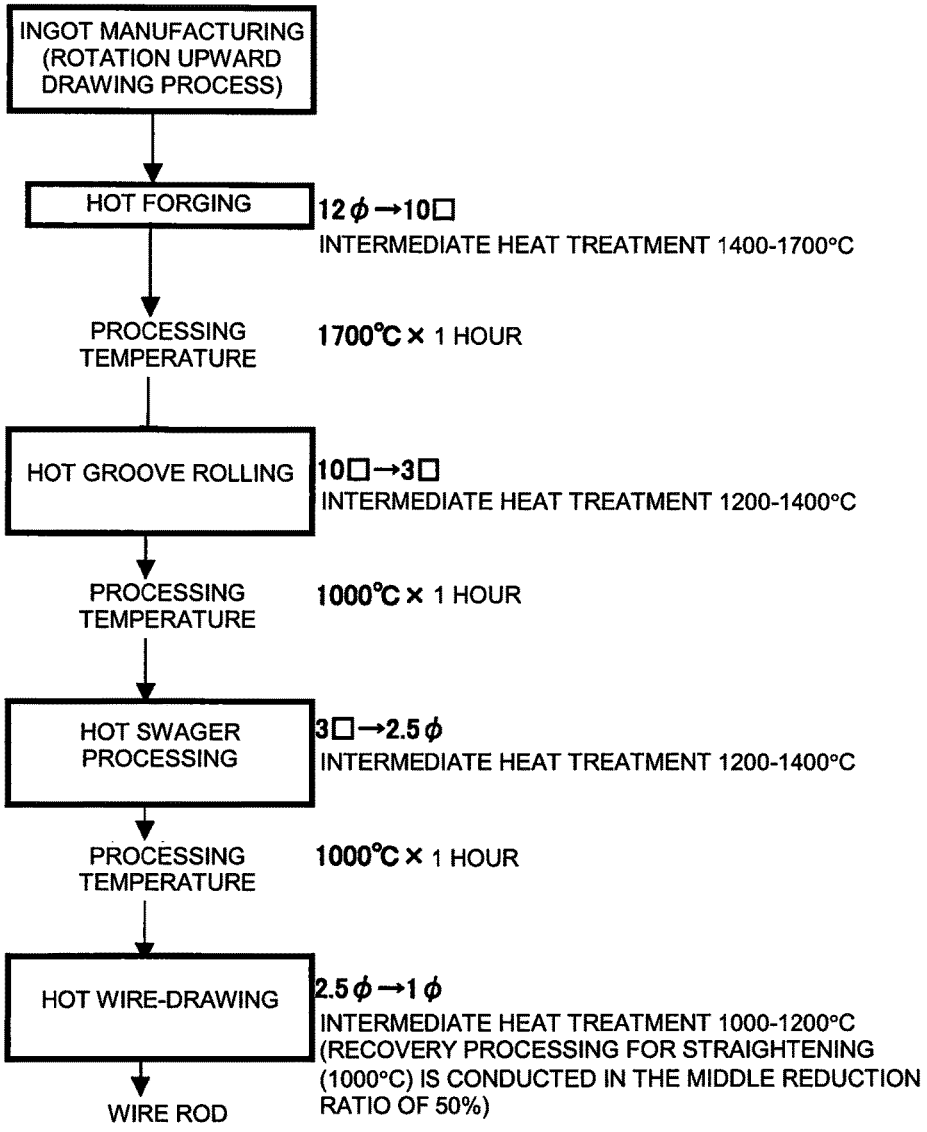
FIG. 2 is a view illustrating a processing step for iridium wire rod in the first embodiment.

The above manufactured iridium ingot was processed into a wire rod through a step shown in FIG. 2. In this processing step, processing were repeatedly conducted at each step of hot forging, hot groove rolling for biaxial pressurization, until target dimensions was obtained. Moreover, at each processing step, hardness of the work piece was appropriately measured to confirm that the hardness is not over 550 Hv. Furthermore, when there was a possibility in that the hardness exceeded 550 Hv due to subsequent processing, intermediate heat treatment was conducted. In the present embodiment, if needed, hot swager processing was added after hot groove rolling.

Figure 3:
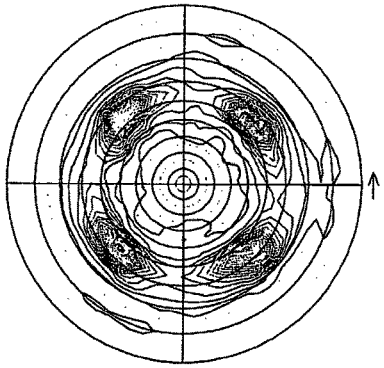
FIG. 3 is an X-ray pole figure of {111} plane in the cross section of an iridium processing material in the first embodiment.
Figure 3:
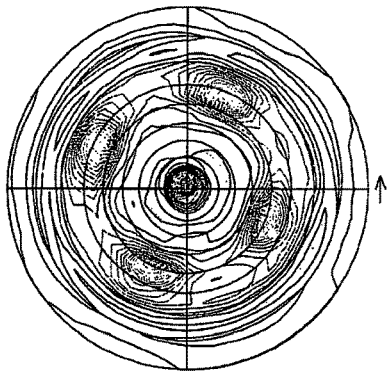
Figure 3:
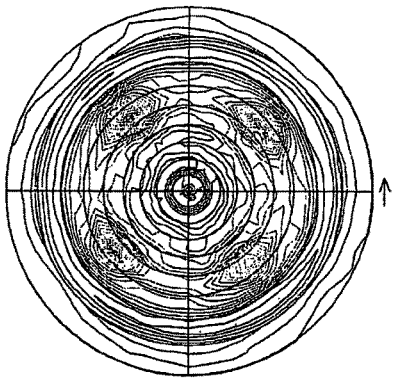
Figure 3:
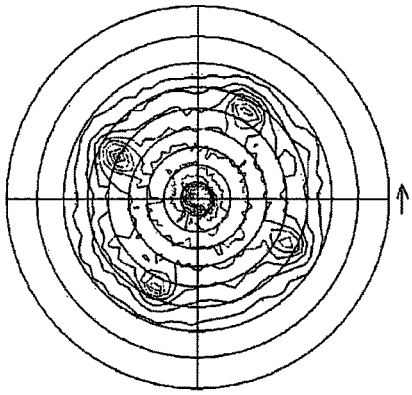

In this processing step, X-ray pole figure analysis (XPFA) was conducted for cross section of the work piece in the middle of the processing. FIG. 3 shows X-ray pole figure of {111} plane in the cross section of the work piece. As can be seen in the Fig., the cross section of the work piece at each processing stage has clear appearance of poles, and it can be confirmed to have texture with good <100> preferred orientation and to maintain its preferred orientation. Furthermore, even in the state of a wire rod, it has <100> preferred orientation.

Second Embodiment

In the above first embodiment, an ingot initially having high crystal orientation at the manufacturing was manufactured by drawing process, and this was the wire rod. In the present embodiment, an iridium ingot was manufactured by a typical melting method and processed with increasing crystal orientation to produce the wire rod. For manufacture of the iridium ingot, the ingot with a diameter of 12 mm was obtained by argon arc melting method. Subsequent processing steps were conducted in a similar manner to the first embodiment.

Figure 4:
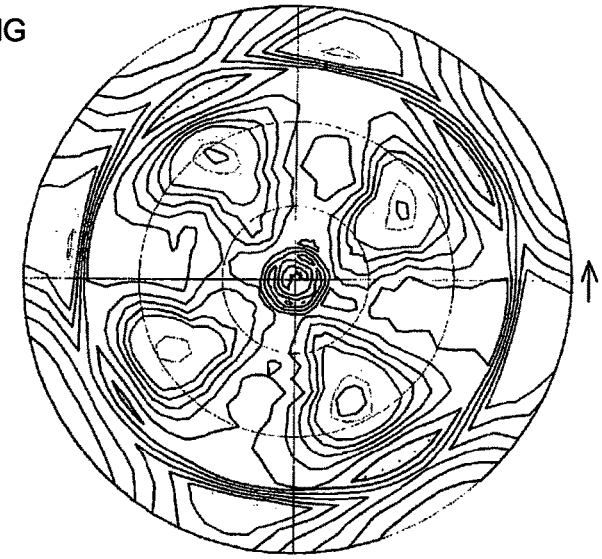
FIG. 4 is an X-ray pole figure of {111} plane in the cross section of iridium processing material in the second embodiment.
Figure 4:
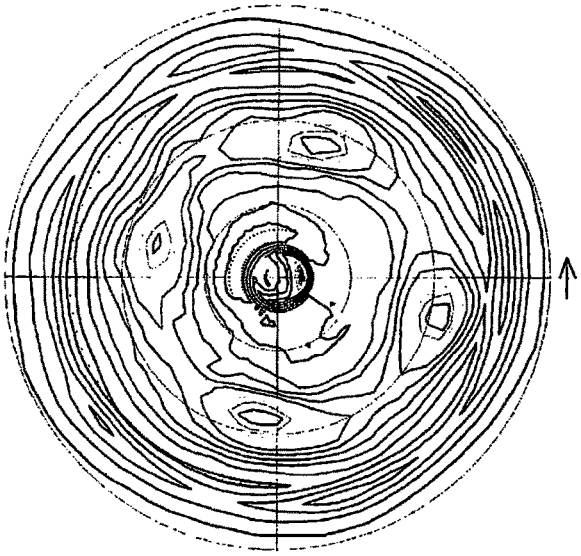

FIG. 4 shows X-ray pole figure of {111} plane in the cross section of the work piece. As can be seen in the figure, it is recognized that the processing material manufactured from the ingot by argon arc melting method also has good crystal orientation.

Third and Fourth Embodiments

Here, wire rods from Pt alloy with 5% Ir by weight and Ir alloy with 10% Pt by weight were processed by steps similar to the first embodiment. To produce these wire rods, ingots manufactured by drawing process were processed, and processed in the conditions similar to the first embodiment.

Comparative Example 1-3

Here, although processing steps themself are similar to the present embodiment in order to confirm the meaning of setting intermediate heat treatment temperatures in the present embodiment, wire rods of iridium-containing alloy were manufactured with setting temperatures of the intermediate heat treatment to temperatures over 1200° C. which is the recrystallization temperature. Note that the ingots were manufactured by arc melting method.

Figure 5:
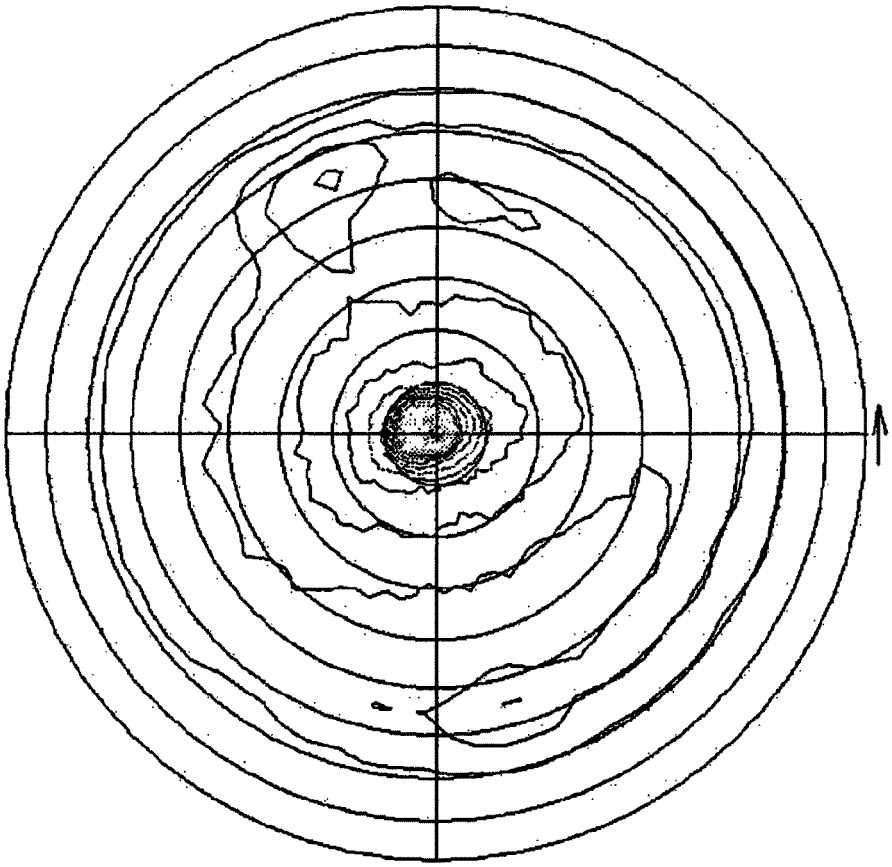
FIG. 5 is an X-ray pole figure of {111} plane of iridium wire rod in Comparative Example.
Figure 6:
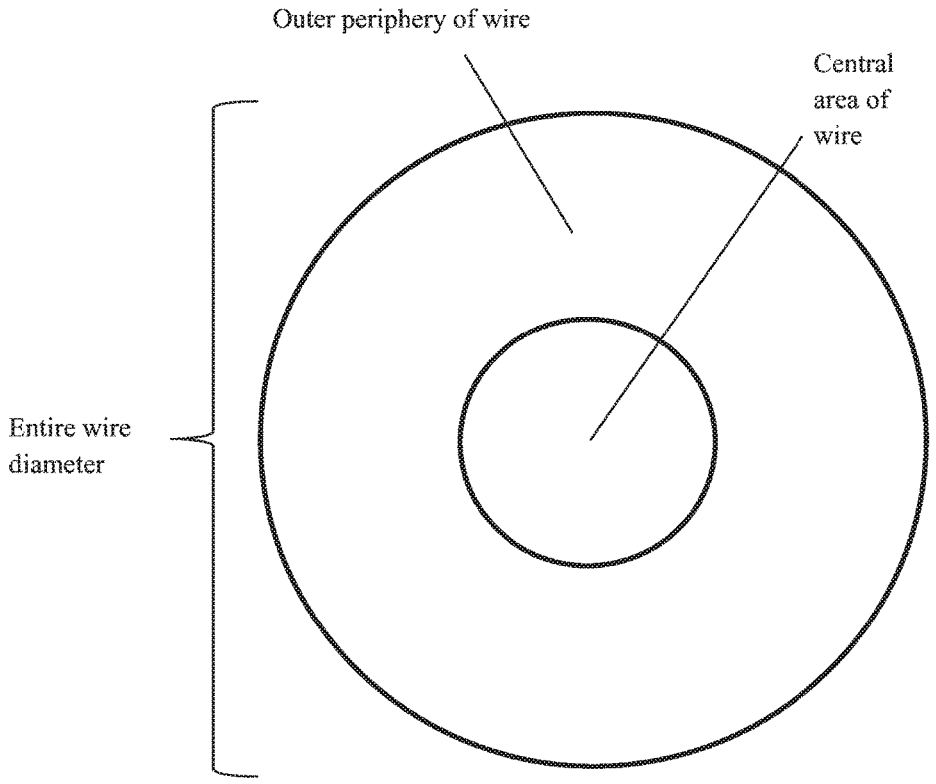
FIG. 6 is a schematic cross-sectional view of a wire rod of the present invention.

X-ray pole figure of {111} in work piece at processing process for these Comparative Examples are shown in FIG. 5. As can be seen in the Fig., wire rods of Comparative Examples are possibly said to be random crystals with small crystal orientation.

Next, for wire rods manufactured in each embodiment and Comparative Example, abundance ratio of crystals having <100> orientation in their cross section were investigated. In this investigation, crystallographic orientation analysis by electron backscatter diffraction pattern analysis (EBSP) was employed. EBSP allows for measuring crystallographic orientation and crystal system in each of crystal grains in inspection zone. Here, with respect to the cross sections of the wire rods, proportion of crystals with <100> orientation was measured in the entire cross section and its periphery. The results are shown in Table 1.

TABLE 1

| | | Abundance rate of <100> orientation crystals | | |
|---|---|---|---|---|
| | Composition | Central area | Periphery | Entire |
| First embodiment | Ir | 85.3% | 57.2% | 60.0% |
| Second embodiment | | 60.1% | 50.2% | 38.8% |

TABLE 1-continued

| | Composition | Abundance rate of <100> orientation crystals | | |
|---|---|---|---|---|
| | | Central area | Periphery | Entire |
| Comparative example 1 | | 38.2% | 14.2% | 19.8% |
| Third embodiment | Ir—5% Pt | 79.9% | 53.0% | 61.0% |
| Comparative example 2 | | 40.3% | 12.4% | 17.8% |
| Fourth embodiment | Pt—30% Ir | 90.1% | 62.1% | 70.3% |
| Comparative example 3 | | 45.0% | 18.2% | 22.6% |

The results of these EBSP coincide with the results of the above X-ray pole figure measurements, and it can be seen that good textures in which crystals with <100> orientation obtain majority are generally indicated. Furthermore, even in the periphery of the wire rods of each embodiment, crystals with <100> orientation are not less than 50%.

After the above physical property identification, wire rods manufactured in each embodiment and Comparative Example were subjected to high-temperature oxidation test. In this test, chip with 1.0 mm length was cut out from each wire rod and this was heated at 1100° C. for 20 hours in the atmosphere, and mass decrease rate was calculated by weight measurements before and after the test. The results are shown in Table 2.

TABLE 2

| | Composition | Mass decrease rate |
|---|---|---|
| First embodiment | Ir | 55% |
| Second embodiment | | 57% |
| Comparative example 1 | | 60% |
| Third embodiment | Ir—5% Pt | 45% |
| Comparative example 2 | | 51% |
| Fourth embodiment | Pt—30% Ir | 15% |
| Comparative example 3 | | 20% |

It can be seen from Table 2 that, in relation to wire rods with random orientation, mass decrease due to high-temperature oxidation is improved in the wire rods of each embodiment having textures with <100> preferred orientation.

INDUSTRIAL APPLICABILITY

The present invention is a material which has good high-temperature oxidation resistance and can be used for a long term in high-temperature oxidative atmosphere. The present invention is suitable for a material which is used in such as spark plug electrode, various sensor electrode, and lead wire in high-temperature oxidative atmosphere.

What is claimed is:

1. A metallic wire rod comprising iridium or an iridium-containing alloy, wherein the wire rod has a diameter of less than 12 mm, which wire rod comprises a central area and an outer periphery, wherein the outer periphery has a biaxial crystal orientation and wherein the outer periphery has an abundance ratio of crystal textures of 50% or more across the diameter of the wire rod, and which outer periphery has a crystallographic orientation which is oriented in the <100> direction.

2. The metallic wire rod according to claim 1, wherein the iridium-containing alloy is an alloy containing rhodium, platinum, and nickel.

3. The metallic wire rod according to claim 1, wherein the metallic wire rod comprises an iridium-containing alloy, which iridium-containing alloy is present in the metallic wire rod in an amount up to 30 wt. % and the balance being platinum.

4. The metallic wire rod according to claim 1, wherein an entire diameter of the wire rod has a biaxial crystal orientation and an abundance ratio of textures of 50% or more.

5. The metallic wire rod according to claim 2, wherein the iridium-containing alloy comprises rhodium, platinum, and nickel in a total amount of up to 5% by weight, and the balance being iridium.

6. A method of manufacturing the metallic wire rod, the wire rod defined claim 1, comprising:

a first step in which an ingot of iridium or an iridium-containing alloy is made into a rod-shape article by biaxial pressurization while intermediate heat treatment is performed, and a second step in which the rod-shape article undergoes wire drawing to be a wire rod, wherein hardness of the ingot in the first step is maintained in not more than 550 Hv, and temperatures of the intermediate heat treatment are set to be not more than the recrystallization temperature of the iridium or an iridium-containing alloy.

7. The method of manufacturing the metallic wire rod according to claim 6, wherein the ingot of iridium or the iridium-containing alloy is manufactured by a rotation upward drawing process.

8. A method of manufacturing the metallic wire rod, the wire rod defined in claim 2, comprising:

a first step in which an ingot of iridium or an iridium-containing alloy is made into a rod-shape article by biaxial pressurization while intermediate heat treatment is performed, and a second step in which the rod-shape article undergoes wire drawing to be a wire rod, wherein hardness of the ingot in the first step is maintained in not more than 550 Hv, and temperatures of the intermediate heat treatment are set to be not more than the recrystallization temperature of the iridium or an iridium-containing alloy.

9. The method of manufacturing the metallic wire rod according to claim 8, wherein the ingot of iridium or the iridium-containing alloy is manufactured by a rotation upward drawing process.

* * * * *